US009771227B2

(12) United States Patent
Allen, Jr. et al.

(10) Patent No.: US 9,771,227 B2
(45) Date of Patent: Sep. 26, 2017

(54) LAYBOY WITH ADJUSTABLE LOWER CONVEYOR AND METHOD FOR OPERATING THE LAYBOY

(71) Applicant: A. G. Stacker Inc., Weyers Cave, VA (US)

(72) Inventors: Clarence C. Allen, Jr., Mt. Crawford, VA (US); Kevin G. Gorby, Harrisonburg, VA (US); Eric H. Crowe, Weyers Cave, VA (US); Samantha L. J. Armstrong, Churchville, VA (US)

(73) Assignee: A.G. STACKER INC., Weyers Cave, VA (US)

( * ) Notice: Subject to any disclaimer, the term of this patent is extended or adjusted under 35 U.S.C. 154(b) by 0 days.

(21) Appl. No.: 14/934,258

(22) Filed: Nov. 6, 2015

(65) Prior Publication Data

US 2016/0130107 A1 May 12, 2016

Related U.S. Application Data

(60) Provisional application No. 62/075,948, filed on Nov. 6, 2014.

(51) Int. Cl.
*B65H 5/02* (2006.01)
*B65H 5/04* (2006.01)
*B65H 29/12* (2006.01)

(52) U.S. Cl.
CPC ..... *B65H 5/023* (2013.01); *B65H 5/025* (2013.01); *B65H 29/12* (2013.01);
(Continued)

(58) Field of Classification Search
CPC ..... B65H 5/023; B65H 5/025; B65H 29/12; B65H 2301/44312; B65H 2301/44316; B65H 2404/25; B65H 2404/253; B65H 2404/2532; B65H 2404/254; B65H 2404/255; B65H 2404/26; B65H 2404/261; B65H 2404/2613; B65H 2404/2693; B65H 2404/693; B65H 2701/1762
See application file for complete search history.

(56) References Cited

U.S. PATENT DOCUMENTS 3,411,773 A * 11/1968 Cornwall ..... B65H 29/36 271/176
4,385,537 A * 5/1983 Wolf ..... B65H 29/12 271/273

(Continued)

*Primary Examiner* — Prasad Gokhale
(74) *Attorney, Agent, or Firm* — J-Tek Law PLLC; Jeffrey D. Tekanic; Scott T. Wakeman

(57) ABSTRACT

A layboy conveyor includes a first end and a second end and an upper conveyor having a top and a bottom and a first end and a second end and a lower conveyor having a top and a bottom and a first end and a second end. The lower conveyor top is disposed adjacent to the upper conveyor bottom and defines with the upper conveyor bottom a transport path configured to transport a sheet of material in a direction from the first end of the layboy conveyor to the second end of the layboy conveyor. A drive is operably connected to the upper conveyor and to the lower conveyor, and the drive is configured to drive the upper conveyor bottom and the lower conveyor top in the direction. A length of the lower conveyor top is adjustable.

20 Claims, 7 Drawing Sheets

(52) U.S. Cl.
CPC ..... *B65H 2301/44316* (2013.01); *B65H 2404/254* (2013.01); *B65H 2404/255* (2013.01); *B65H 2404/2532* (2013.01); *B65H 2404/264* (2013.01); *B65H 2404/2613* (2013.01); *B65H 2404/63* (2013.01); *B65H 2404/693* (2013.01); *B65H 2601/261* (2013.01); *B65H 2701/1762* (2013.01)

(56) References Cited

U.S. PATENT DOCUMENTS

| | | | | |
|---|---|---|---|---|
| 5,855,368 | A * | 1/1999 | Middelberg ..... | B65H 5/023 198/588 |
| 7,954,628 | B2 * | 6/2011 | Allen, Jr. ..... | B65G 51/32 198/592 |
| 8,322,719 | B1 * | 12/2012 | Roth ..... | B65H 29/12 271/198 |
| 2009/0085273 | A1 * | 4/2009 | Nagai ..... | B65H 5/023 271/1 |
| 2011/0056797 | A1 * | 3/2011 | Tsai ..... | B07B 13/04 198/374 |

* cited by examiner

LAYBOY WITH ADJUSTABLE LOWER CONVEYOR AND METHOD FOR OPERATING THE LAYBOY

CROSS-REFERENCE TO RELATED APPLICATIONS

The present application claims the benefit of U.S. Provisional Patent Application No. 62/075,948 filed Nov. 6, 2014, the entire contents of which is hereby incorporated by reference.

TECHNOLOGICAL FIELD

The present disclosure is directed to an adjustable layboy conveyor configured to receive sheets output by a sheet outputting device such as a rotary die cut machine and to a method of adjusting same, and, more specifically, to a layboy conveyor configured to receive sheets output by a sheet outputting device such as a rotary die cut machine which layboy conveyor has a first portion adjustable relative to a second portion and to a method of adjusting the layboy conveyor.

BACKGROUND

A conventional stacking apparatus 10 is illustrated in FIG. 1. The stacking apparatus 10 is configured for use adjacent to a rotary die cut machine 12 which cuts blanks (not illustrated) from sheets of material, for example, corrugated paperboard. The stacking apparatus 10 includes a receiving or "layboy" section 14 (sometimes referred to herein as a "layboy conveyor") that receives the blanks from the die cut machine 12 and discharges them onto a transfer conveyor 16. The transfer conveyor 16 carries the blanks to an inclined main conveyor 18 along which the blanks travel and from which they are dropped to form a stack. The disclosure is directed to an improved layboy section of a stacker, and this layboy section can be used as the layboy section of any conventional stacker design. Further details regarding stackers can be found in U.S. Pat. No. 7,753,357 assigned to A.G. Stacker Inc., the entire contents of which is hereby incorporated by reference.

A conventional die cut machine is provided with webs or sheets of material from which blanks having a desired shape are cut. Die cut machines produce a certain amount of scrap material during operation which consists mainly of the portions of the input material that do not become part of a finished blank. In addition, each blank may include slots or through-openings. The material cut from the blank to form these slots and through-openings also constitutes scrap.

Most scrap material produced by the die cut machine drops beneath or immediately in front of the die cut machine as it operates. However, scrap material, especially small, lightweight pieces of scrap material, may be ejected from the die cut machine in such a manner that it falls into the layboy section from above or is drawn into the intake end of the layboy section either alone or along with the blanks Excessive scrap in the transport path between the layboy section and the final stack of blanks may adversely affect the transport of the blanks That is, the scrap may interfere with the alignment of the blanks or lead to jams. Alternately, if the scrap is carried all the way through the stacker and into the final stack of blanks, the blanks in the stack will have gaps therebetween where the scrap material is present thus resulting in a crooked, or oversized or non-uniform stack of blanks It would therefore be desirable to provide an apparatus and method for reducing the amount of scrap material from a die cut machine that enters the layboy section of a stacker.

SUMMARY

The present disclosure is directed to an improved stacker layboy section that is configured to reduce the amount of scrap that enters the layboy section and the transport path of the stacker.

As used herein, the direction in which the belts of upper and lower layboy conveyor sections are oriented may be referred to as a longitudinal direction, and the direction perpendicular to this direction may be referred to as a transverse direction. The direction from the die cut machine to the stacker main conveyor may be referred to as the downstream direction, and the layboy is located upstream from the main conveyor.

It is generally desirable to keep the upstream end of a layboy conveyor relatively close to the output of a die cut machine. This helps ensure that the blanks are engaged by the belts of the layboy before they are released from the nip of the die cut machine. If the layboy is too far from the die cut machine, blanks exiting the die cut machine may sag or deviate from the longitudinal direction before being captured by the nip of the layboy. This can adversely affect the later orientation, transport and stacking of the blanks and possibly lead to jams in the stacker. The shorter the length of the blanks in the longitudinal direction, the closer the layboy must be to the die cut machine. However, even blanks that are relatively long in the longitudinal direction may droop or sag if they are not engaged by the layboy conveyors relatively soon after exiting the die cut machine.

There are disadvantages, however, in placing the layboy section of a stacker too close to the exit of a die cut machine. If the gap too small in the blank transport direction, scrap may accumulate in the gap and be drawn into the layboy. Alternately or in addition, the scrap may build up between portions of the layboy and the die cut machine and interfere with the free movement of blanks from the die cut machine to the layboy. The gap must therefore be small enough to maintain adequate control of the orientation of the blanks exiting the die cut machine but large enough to allow all or substantially all of the scrap produced by the die cut machine to fall away from the layboy. The proper distance cannot always be determined ahead of time and will depend, among other factors, on the longitudinal and transverse dimensions of the blanks and the size and shape of the scrap being produced by a particular die on the die cut machine and the speed at which the die cut machine is operating.

The layboy of the present disclosure includes a lower layboy conveyor having an upstream end that is movable relative to its downstream end and relative to a die cut machine positioned at the input end of the layboy. By moving the upstream end of the lower layboy conveyor, the configuration of the gap between the layboy and the die cut machine can be adjusted to achieve a balance between control of the blanks exiting the die cut machine and the amount of scrap that enters the layboy or accumulates at the entrance of the layboy. Importantly, the upper conveyor of the layboy does not contribute significantly to scrap accumulation. Therefore, it is only necessary to change the length of the lower layboy conveyor, that is, the location of the upstream end of the lower layboy conveyor, to optimize the relationship between the layboy and the die cut machine for receiving a given size and shape of blank. The upstream end of the upper layboy conveyor is fixed (in the longitudinal direction) relative to its downstream end and relative to the die cut machine.

The position of the input end of the lower layboy conveyor can be determined empirically and adjusted during operation of the stacker. That is, a gap can be set between the die cut machine and the layboy that is expected to provide good control over the orientation of the blanks entering the layboy. If scrap accumulates at the layboy input, or if scrap is being entrained between the layboy conveyors, the end of the lower layboy conveyor can be moved away from the die cut machine to increase the size of the gap between the lower layboy conveyor and the die cut machine to allow a greater amount of scrap to fall away from the layboy without adversely affecting blank transport. If a gap is obtained that seems to adequately avoid scrap material entrainment but it is found that control over blank orientation is inadequate, the size of the gap can be slowly decreased until the necessary degree of control is regained. When an acceptable gap size is found for a particular blank, that gap size can be recorded, in a non-volatile memory associated with a controller of the stacker, for example, and used on future runs of a particular blank or used as a starting gap size for blanks that are similar in size or shape to the particular blank and which are expected to require a similar gap size.

A first aspect of the disclosure therefore comprises a layboy conveyor having a first end and a second end and an upper conveyor having a top and a bottom and a first end and a second end and a lower conveyor having a top and a bottom and a first end and a second end. The lower conveyor top is disposed adjacent to the upper conveyor bottom and defines with the upper conveyor bottom a transport path configured to transport a sheet of material in a direction from the first end of the layboy conveyor to the second end of the layboy conveyor. The layboy conveyor also includes a drive operably connected to the upper conveyor and to the lower conveyor, the drive being configured to drive the upper conveyor bottom and the lower conveyor top in the direction. The length of the lower conveyor top is adjustable.

Another aspect of the disclosure is a layboy conveyor having a first end and a second end and an upper conveyor having a top and a bottom and a first end and a second end and a lower conveyor having a top and a bottom and a first end and a second end. The lower conveyor top is disposed adjacent to the upper conveyor bottom and defines with the upper conveyor bottom a transport path configured to transport a sheet of material in a direction from a nip at the first end of the layboy conveyor to the second end of the layboy conveyor. The conveyor also includes a drive operably connected to the upper conveyor and to the lower conveyor, and the drive is configured to drive the upper conveyor bottom and the lower conveyor top in the direction. The layboy conveyor also includes adjusting means for changing a distance between the nip and the second end of the layboy conveyor.

A further aspect of the disclosure comprises a method that involves providing a layboy conveyor, the layboy conveyor having an upper conveyor having a top and a bottom and a first end and a second end, and a lower conveyor having a top and a bottom and a first end and a second end, the lower conveyor top being disposed adjacent to the upper conveyor bottom and defining with the upper conveyor bottom a transport path configured to transport a sheet of material in a direction from the first end of the layboy conveyor to the second end of the layboy conveyor, and a drive operably connected to the upper conveyor and to the lower conveyor and configured to drive the upper conveyor bottom and the lower conveyor top in the direction. The method also includes positioning the layboy conveyor with the first end of the upper conveyor and the first end of the lower conveyor adjacent to an output of a sheet feeding apparatus such that the first end of the upper conveyor is spaced a first distance from the sheet feeding apparatus and the first end of the lower conveyor is spaced a second distance from the sheet feeding apparatus, and changing second distance without changing the first distance.

DETAILED DESCRIPTION

Figure 1:
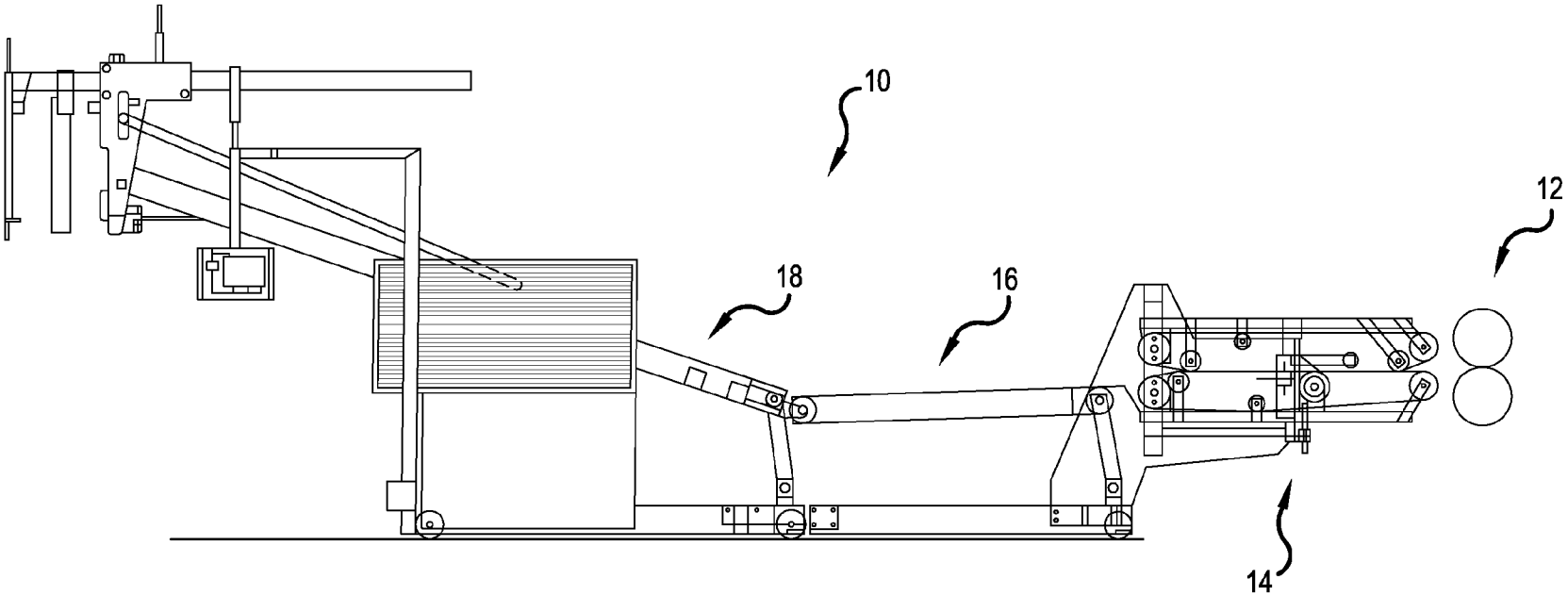
FIG.1 CONVENTIONAL ART
FIG. 1 is a side elevational view of a conventional stacker that includes a layboy section adjacent to a die cut machine.

A section of a layboy 20 according to an embodiment of the present disclosure is illustrated in FIGS. 2-5. The layboy section 20 includes an upper conveyor formed from a plurality of upper conveyor sections 22. Each of the upper conveyor sections 22 comprises a pair of frame elements 24, a first support roller 26 mounted between the pair of frame elements 24 at a first or upstream end 28 of the upper conveyor section 22 and a second support roller 30 mounted between the pair of frame elements 24 at a second or downstream end 32 of the upper conveyor section 22. Two tensioning rollers 34 are supported by the frame elements 24 midway between the first support roller 26 and the second support roller 30. A flexible belt 36 extends around the first support roller 26 and the second support roller 30 and between the tensioning rollers 34. The frame elements 24 provide support for the support rollers and in the present embodiment, each of the pair of frame elements 24 is formed from two rigidly connected plate members. The particular structure of the frame elements 24 is not critical to the present disclosure, and differently configured frame elements could be used without exceeding the scope of the present disclosure.

Figure 6:
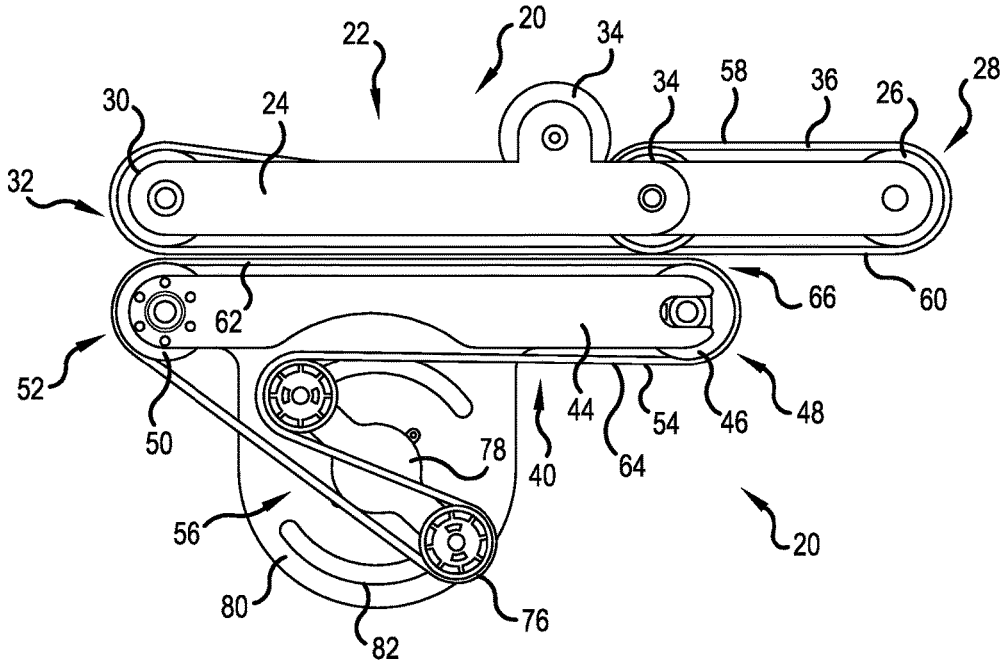
FIG. 6 is a side elevational view of the conveyor sections of FIG. 2 with the upstream end of the lower layboy conveyor section shifted to a retracted position.
Figure 7:
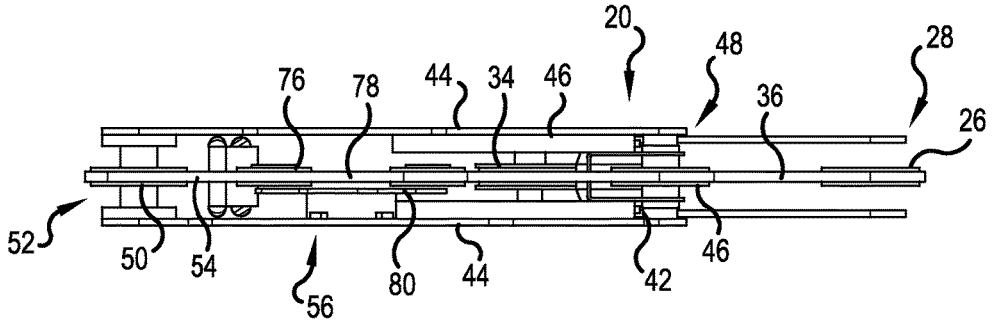
FIG. 7 is a bottom plan view of the conveyor sections of FIG. 6.
Figure 8:
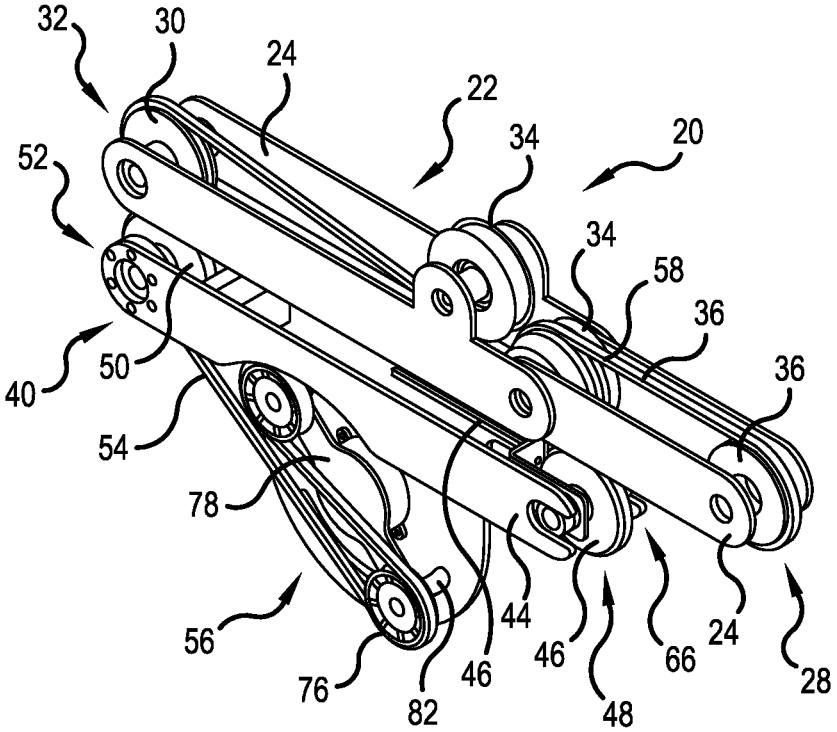
FIG. 8 is an end elevational view of the conveyor sections of FIG. 6.
Figure 9:
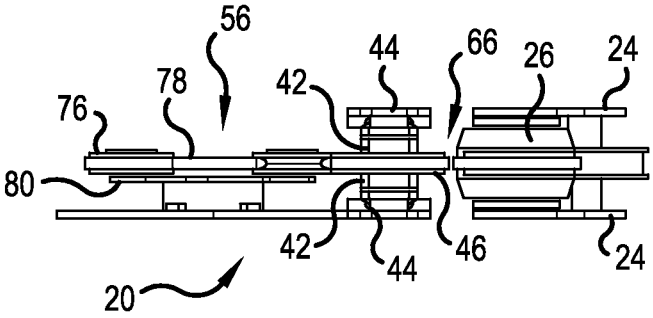
FIG. 9 is a perspective view of the conveyor sections of FIG. 6.

The layboy section 20 also includes a lower conveyor formed from a plurality of lower conveyor sections 40. Each of the lower conveyor sections 40 comprises a pair of first frame elements 42 slidably mounted to a pair of second frame elements 44 and guided by guide rails 46 (see FIGS. 5 and 6) on the facing inner sides of the second frame elements 44. A first support roller 46 is mounted between the pair of first frame elements 42 at a first or upstream end 48 of the lower conveyor section 40 and a second support roller 50 is mounted between the pair of second frame elements 44 at a second or downstream end 52 of the lower conveyor section 40. A flexible belt 54 extends around the first support roller 46 and the second support roller 50 and through a tensioning mechanism 56 described hereinafter.

Figure 10:
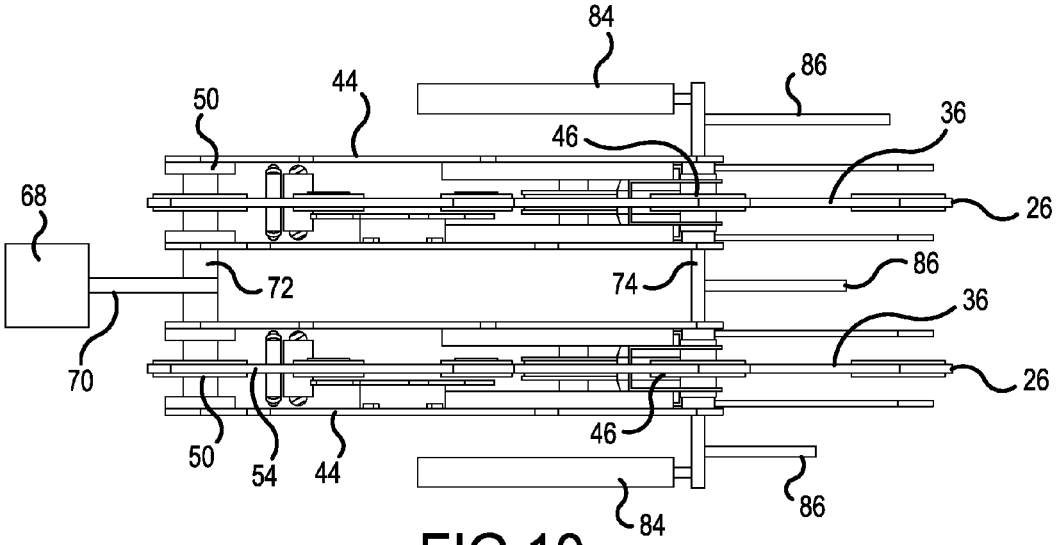
FIG. 10 is a bottom plan view of a pair of adjacent layboy conveyor sections with their upstream ends retracted (e.g., in the position of FIG. 6).
Figure 11:
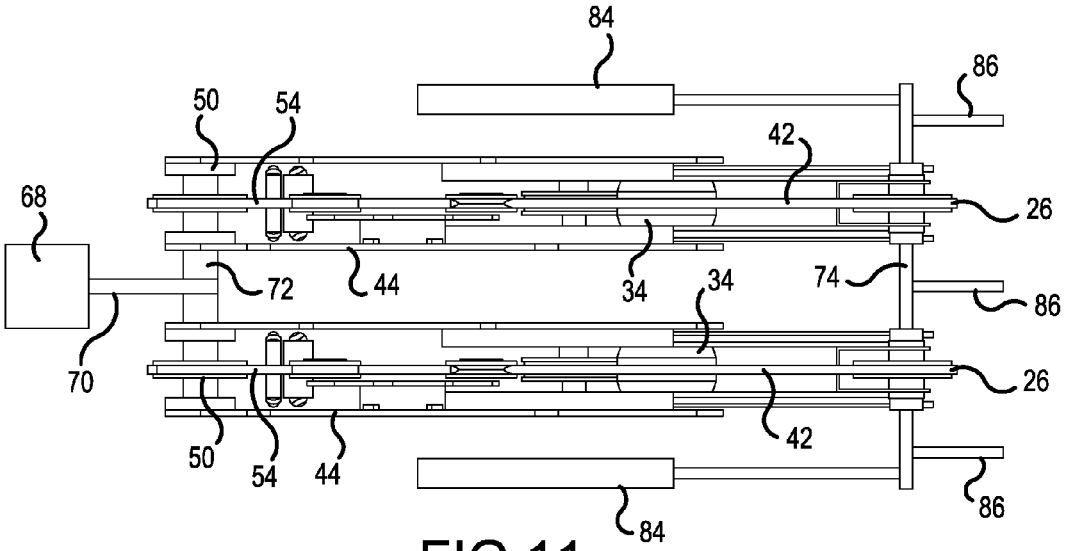
FIG. 11 is a bottom plan view of the pair of adjacent layboy conveyor sections with their upstream ends extended (e.g., in the position of FIG. 2).

The plurality of belts 36 of the upper conveyor sections 22 are disposed next to each other in the transverse direction, and the plurality of belts 54 of the lower conveyor sections 40 are disposed next to each other in the transverse direction. Only a single upper and lower conveyor section 22, 40 are illustrated in each of FIGS. 2-9, and a pair of adjacent conveyor sections are illustrated in FIGS. 10 and 11. A typical upper or lower layboy conveyor may comprise 8, 10, 12 or more conveyor sections arranged next to each other with their belts parallel.

In the present embodiment, the various support and tensioning rollers all comprise flanged wheels each having a radially outwardly facing channel for guiding a belt. In other embodiments, the support wheels could comprise cylindrical rollers for supporting one or more belts—either one belt per upper or lower conveyor section or one wide belt (not illustrated) having a width substantially equal to an overall width of the layboy section 20 which wide belt could be supported by the rollers of a plurality of adjacent conveyor sections. As used herein, the phrase "support roller" is intended to cover cylindrical rollers, flanged wheels, and other structures for supporting a continuous belt and allowing and/or causing the belt to rotate.

The upper conveyor section 22 has a top 58 comprising the portion of the upper conveyor section flexible belt 36 that is further from the lower conveyor section 40 and a bottom 60 comprising the portion of the upper conveyor section flexible belt 36 that is closer to the lower conveyor section 40. The lower conveyor section 40 has a top 62 comprising the portion of the lower conveyor section flexible belt 54 that is closer to the upper conveyor section 22 and a bottom 64 comprising the portion of the lower conveyor section flexible belt 54 that is further from the upper conveyor section 22. The bottom 60 of the upper conveyor section 22 and the top 62 of the lower conveyor section 40 are closely spaced and define between them a transfer path for carrying sheets of material, cardboard blanks, for example, in a direction from the upstream end 48 of the lower conveyor section 40 toward the downstream end 52 of the lower conveyor section 40. A nip 66 is defined between the upstream end 28 of the upper conveyor section 22 and the upstream end 48 of the lower conveyor section 40 where incoming sheets of material enter the transport path.

A drive 68 for driving the upper conveyor section 22 and the lower conveyor section 40 is schematically illustrated in FIGS. 10 and 11 but omitted from the other figures for clarity. The drive 68 may be, for example, an electric motor and may include a drive belt or chain 70 connected between the drive 68 and a shaft 72 that supports the second support rollers 50 of adjacent lower conveyor sections 40. Moreover, suitable gears (not illustrated) may be provided so that the rotation of the shaft 72 is transmitted to a shaft 74 that supports the second support rollers 50 of adjacent upper conveyor sections 22 to cause the second support rollers 50 of the lower conveyer section 44 and of the upper conveyor section 22 to rotate in opposite directions. As discussed further below, the drive 68 thus causes the bottom 60 of the upper conveyor and the top 62 of the lower conveyor second 40 to move in the same direction, a direction from the upstream end 28 of the upper conveyor section 22 to the downstream end 32 of the upper conveyor section 22. Other conventional mechanisms for driving the layboy section 20 are known in the art and can be employed without exceeding the scope of this disclosure.

Figure 2:
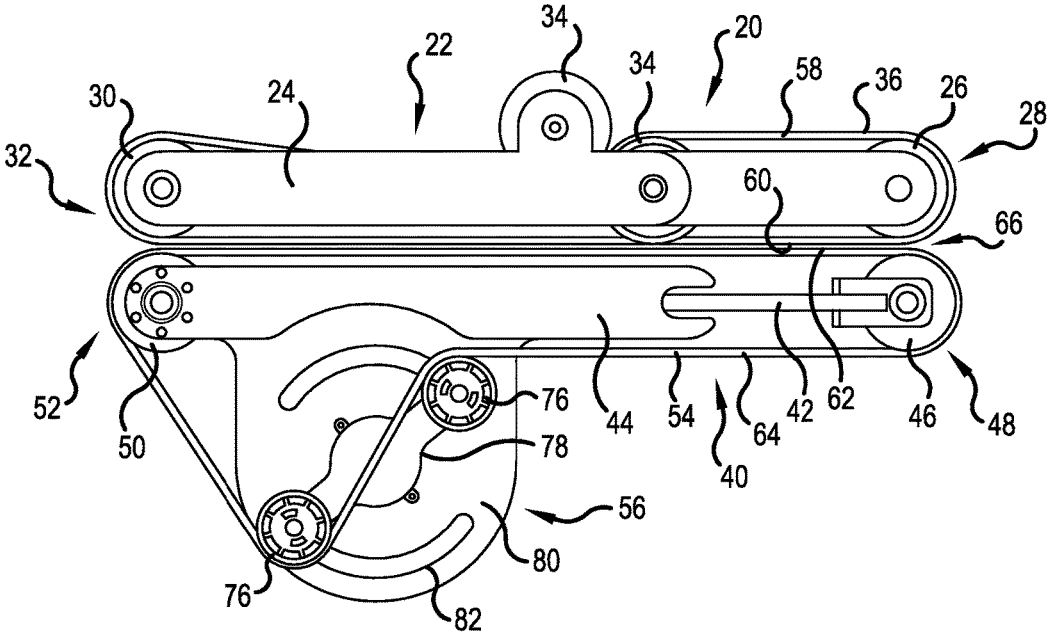
FIG. 2 is a side elevational view of a section of an upper layboy conveyor next to a section of a lower layboy conveyor with the upstream end of the section of the lower conveyor generally aligned with the upstream end of the section of the upper conveyor.
Figure 3:
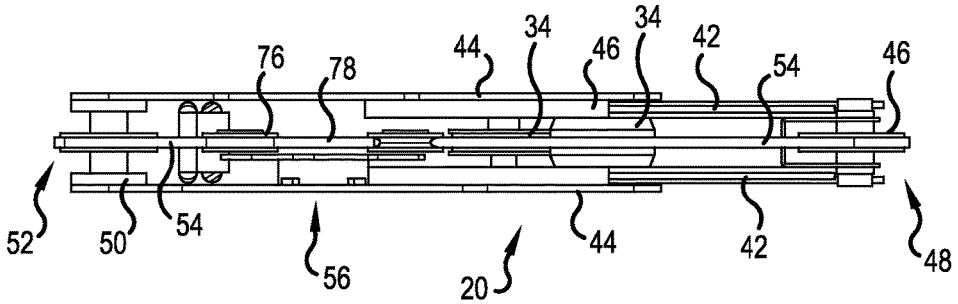
FIG. 3 is a bottom plan view of the conveyor sections of FIG. 2.
Figure 4:
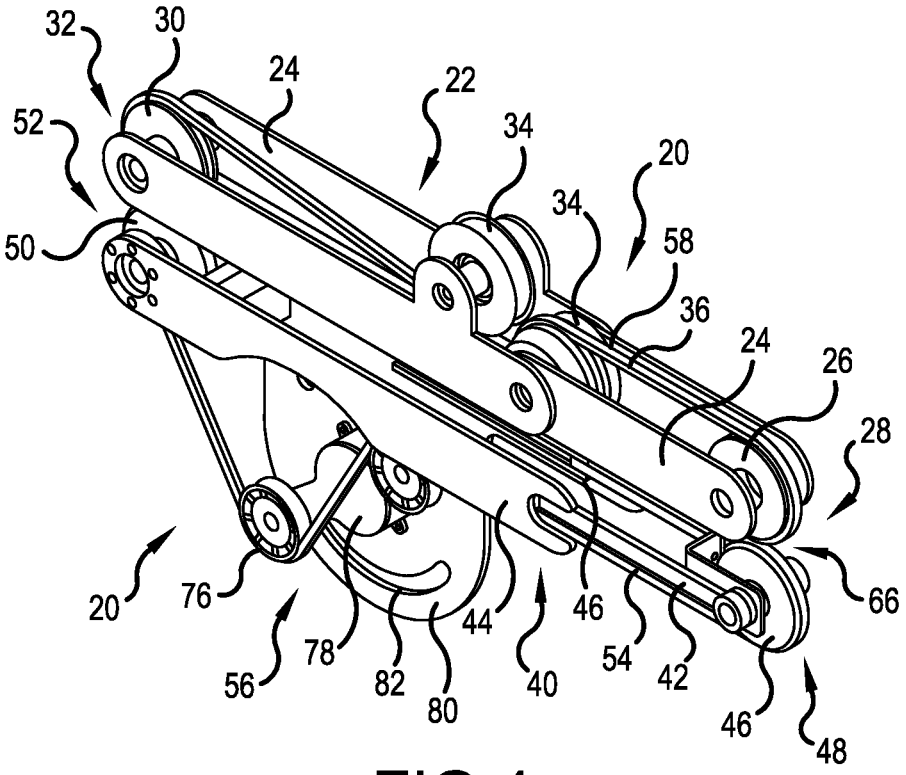
FIG. 4 is an end elevational view of the conveyor sections of FIG. 2.
Figure 5:
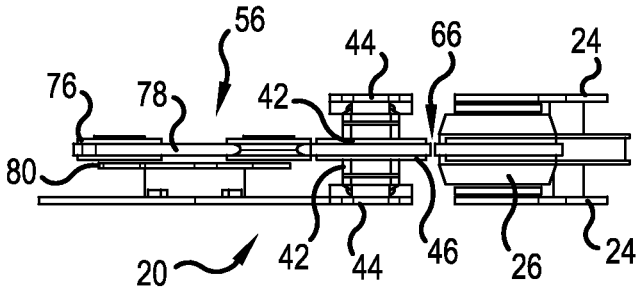
FIG. 5 is a perspective view of the conveyor sections of FIG. 2.

The lower conveyor sections 40 of the layboy 20 are adjustable, and the lengths of the lower conveyor sections 40 can be changed by moving the upstream ends 48 of the lower conveyor sections 40 relative to their the downstream ends 52. FIG. 2 illustrates a lower conveyor section 40 with its upstream end 48 in an extended position generally aligned with the upstream end 28 of the upper conveyor section 22. This allows the nip 66 of the layboy 14 to be located close to the output of a die cut machine (not illustrated).

FIGS. 6-9 show the layboy 20 of the present disclosure with the upstream ends 48 of the lower conveyor sections 40 retracted relative to their downstream ends 52 and shifted in a downstream direction from the upstream ends 28 of the upper conveyor sections 22 so that they are located at a greater distance from the die cut machine than they are in FIGS. 2-5. This configuration leaves the nip 66 of the layboy 14 at a greater distance from the die cut machine.

As the distance between the upstream ends 48 of the lower conveyor sections 40 and their downstream ends 52 decreases, other portions of the belt travel path must be lengthened to prevent slack from developing in the belts. A slack take-up or tensioning mechanism 56, illustrated in FIGS. 2-9, is provided on each of the lower conveyor sections 40 for adjusting the travel paths of the belts 54 of the lower conveyor sections 40 and for maintaining a substantially constant tension in the belts 54.

These slack take-up mechanisms 56 each comprise first and second flanged wheels 76 disposed on opposite ends of an arm 78 mounted for rotation relative to a support plate 80 on each of the lower conveyor sections 40 which support plates 80 include first and second arcuate guide slots 82. Each arm 78 is biased by a spring or other mechanism (not illustrated) in the counterclockwise direction as viewed in FIGS. 2 and 6. The upstream ends 48 of the lower conveyor sections 40 are drawn away from the downstream ends 52 of the lower conveyor sections 40 by a mechanism described below which overcomes the biasing force of the spring and allows the arm 78 to rotate clockwise from the position illustrated in FIG. 6 to the position illustrated in FIG. 2. When the upstream ends 48 of the lower conveyor sections 40 are moved from the position of FIG. 2 to the position of FIG. 6, the springs cause the arms 78 to rotate counterclockwise back toward the position of FIG. 6 while at the same time maintaining a substantially constant tension on the belts 54 of the lower conveyor sections 40.

FIGS. 10 and 11 are bottom plan views of two adjacent layboy sections 20 showing a pair of upper conveyor sections 22 and lower conveyor sections 40. As discussed above, a typical layboy will generally have 8 or more conveyor sections, and only two sections are discussed for ease of illustration and explanation. As illustrated in these figures the upstream ends 48 of the lower conveyor sections 40 are interconnected by a shaft 74, which shaft 74 may comprise, for example, part of an axle on which the first support rollers 26 are mounted for rotation. Shaft 74, and thus the upstream ends 48 of the lower conveyor sections 40, is movable in the longitudinal direction toward and away from the downstream ends 52 of the lower conveyor sections 40 to shift the lower conveyor sections 40 from the configuration illustrated in FIGS. 6 and 10 to the configuration illustrated in FIGS. 2 and 11.

FIGS. 10 and 11 illustrate a pair of pneumatic cylinders 84 mounted to a frame (not illustrated) of the layboy 14 which move, under the direction of a controller (not illustrated) that may comprise a microprocessor or a programmable logic controller, either specifically for controlling the layboy 14 or the microprocessor or programmable logic controller that controls the operation of the stacker 10). The pneumatic cylinders 84 move between the position illustrated in FIG. 10 and the position illustrated in FIG. 11. The use of pneumatic cylinders is not required, and the shaft 74 could be moved by other arrangements of actuators, pneumatic, electromechanical or otherwise, or moved manually, without exceeding the scope of this disclosure.

As discussed above, the position of the upstream ends 48 of the lower conveyor sections 40 is determined by balancing the need to provide sufficient space for scrap to fall from the die cut machine 12 before reaching the upstream ends 48 of the lower conveyor sections 40 and the need to keep the nip 66 of the layboy close enough to the die cut machine 12 to provide adequate control of the blanks exiting the die cut machine 12 before reaching the nip 66.

Figure 12:
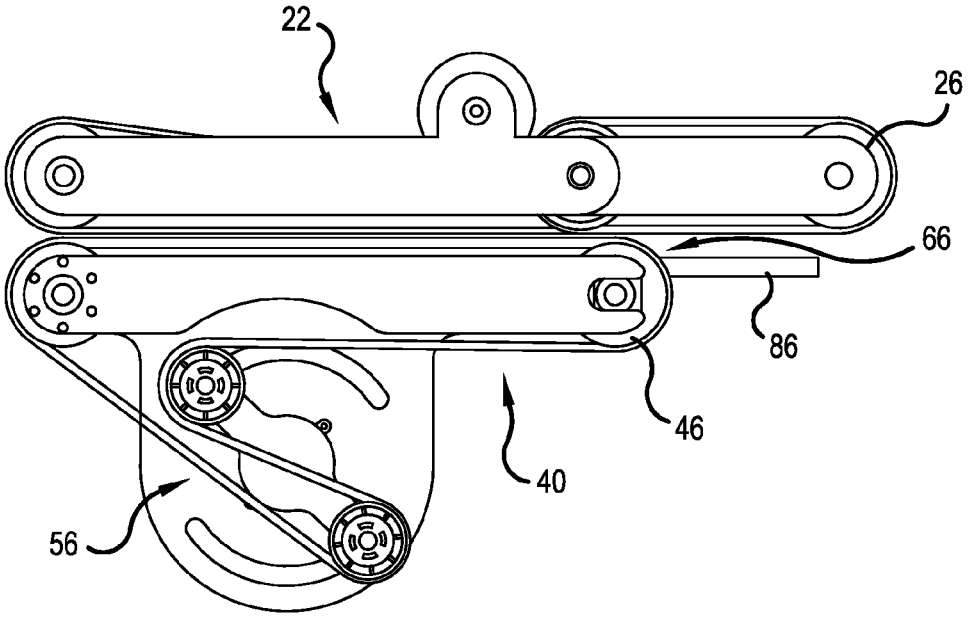
FIG. 12 illustrates a plurality of support rods projecting from the upstream end of the lower conveyor.

It may sometimes be the case that the optimal position for the upstream ends 48 of the lower conveyor sections 40 for reducing scrap entrainment is further from the die cut machine 12 than the optimal position for controlling the position and/or alignment of blanks. To address this issue and allow the upstream ends 48 of the lower conveyor sections 40 to be positioned for minimal scrap entrainment, the shaft 74 may optionally include a plurality of support rods 86, illustrated in FIG. 12, that extend in the upstream direction from the shaft 74 and which move with the shaft 74. (The support rods 76 are omitted from FIGS. 2-9 for clarity.) Blanks that exit the die cut machine 12 and begin to droop downward will engage the support rods 86 and slide along the support rods 86 until arriving at the nip 66. However, since the support rods 86 have a smaller transverse cross section than the lower conveyor sections 26, they do not significantly interfere with the movement of scrap as it drops away from the die cut machine 12 and they do not actively draw scrap into the nip 66 as do the belts 36, 54 of the upper and lower conveyor sections 22, 40. Using the support rods 86 thus allows the upstream ends 48 of the lower conveyor sections 40 to be positioned further from the die cut machine 12 than would otherwise be possible while maintaining adequate control over the blanks.

Figure 13:
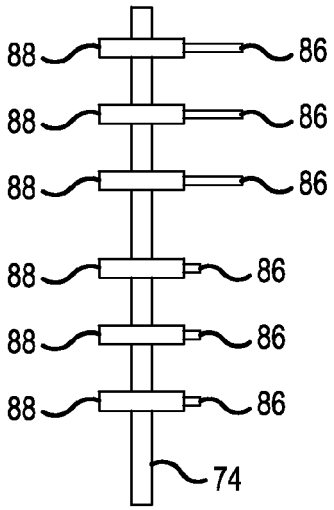
FIG. 13 is a top plan view of an alternate configuration for the support rods of FIG. 12.
Figure 14:
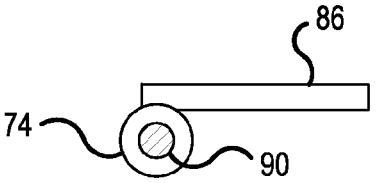
FIGS. 14 and 15 are side elevational views of an alternate configuration of the support rods of FIG. 12.
Figure 15:
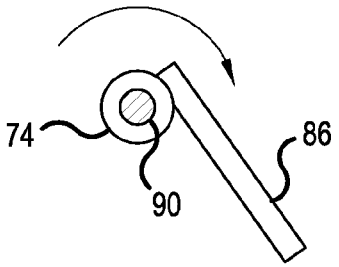

The support rods 86 may comprise substantially rigid members fixed to the rod 50 such as by welding. In the alternative, the support rods 86 may be movable and controllable so that they do not contact or interfere with the die cut machine 12 when the upstream ends 48 of the lower conveyor sections 40 are in the position illustrated in FIGS. 2 and 11. For example, as illustrated in FIG. 13, the rods 86 may comprise pistons of pneumatic actuators 88 and be controlled to extend and retract based on the longitudinal position of the shaft 74. As a further alternative, the support rods 86 may be rotatably mounted to the shaft 74, for example, by a bearing 90, and controlled to pivot from the position of FIG. 14 when the upstream ends 48 of the lower conveyor sections 40 are in the position of FIG. 6 to the position of FIG. 15 when the upstream ends 48 of the lower conveyor sections 40 are in the position of FIG. 2.

In operation, an initial gap is set between the rotary die cut machine 12 and the upstream end 28 of the upper conveyor section 20 in a convention manner. The initial gap is selected to have the smallest size that is expected to be needed for the blanks to be output from the rotary die cut machine 12 and stacked by the stacker 10. For example, if the stacker 10 and rotary die cut machine 12 are generally used to move blanks that are two to three feet long, the gap between the rotary die cut machine 12 and the layboy will be set accordingly. During operation, an operator will observe whether scrap is being caught in the layboy section. If scrap entrainment is observed, the upstream ends 48 of the lower conveyor sections 40 can be moved away from the rotary die cut machine 12 to move the nip 66 of the layboy further away from the rotary die cut machine 12, and this will decrease the amount of scrap drawn into the layboy. The support rods 86 may be partially or fully extended, if necessary, to support the blanks exiting the rotary die cut machine 12 as they approach the nip 66. If this new spacing between the rotary die cut machine 12 and the nip 66 does not provide adequate control over the alignment of the blanks traversing the layboy, the upstream ends 48 of the lower conveyor sections 40 can be moved closer to the rotary die cut machine. The final position of the nip 66 will likely be determined by the machine operator to strike a suitable balance between scrap entrainment and alignment control.

A method according to the disclosure includes providing a layboy conveyor as described above, positioning the layboy conveyor with the first end of the upper conveyor and the first end of the lower conveyor adjacent to an output of a sheet feeding apparatus such that the first end of the upper conveyor is spaced a first distance from the sheet feeding apparatus and the first end of the lower conveyor is spaced a second distance from the sheet feeding apparatus, and changing second distance without changing the first distance.

The present invention has been described herein in terms of presently preferred embodiments. Additions to and modifications of these embodiments will become apparent to persons of ordinary skill in the art upon reading the foregoing disclosure. These additions and modifications are intended to be included within the scope of the present invention to the extent they fall within the scope of the several claims appended hereto.

We claim:

1. A layboy conveyor having a first end and a second end and comprising:

an upper conveyor having a top and a bottom and a first end and a second end;

a lower conveyor having a top and a bottom and a first end and a second end, the lower conveyor top being disposed adjacent to the upper conveyor bottom and defining with the upper conveyor bottom a transport path configured to transport a sheet of material in a direction from the first end of the layboy conveyor to the second end of the layboy conveyor; and a drive operably connected to the upper conveyor and to the lower conveyor, the drive configured to drive the upper conveyor bottom and the lower conveyor top in the direction, wherein the first end of the lower conveyor is movable in the direction to reduce a length of the lower conveyor top.

2. The layboy conveyor of claim 1, wherein a length of the upper conveyor bottom is fixed.

3. The layboy conveyor of claim 1, wherein the lower conveyor includes at least one tensioning roller configured to maintain a substantially constant tension on a belt of the lower conveyor when the length of the lower conveyor bottom is adjusted.

4. The layboy conveyor of claim 1, wherein the lower conveyor comprises a first frame element slidably connected to a second frame element, a first support roller mounted on the first frame element, a second support roller mounted on the second frame element, a belt extending around the first support roller and the second support roller and at least one first actuator operably connected to the first frame element and configured to shift the first frame element relative to the second frame element to change a distance between the first support roller and the second support roller.

5. The layboy conveyor of claim 4, further including at least one slack take-up roller supported by the second frame element and in contact with the belt and configured to maintain a substantially constant tension on the belt when the first actuator changes the distance between the first support roller and the second support roller.

6. The layboy conveyor of claim 4, further including an arm rotatably mounted on the second frame element, the arm including a first roller at a first end of the arm and a second roller at a second end of the arm, and a spring connected to the arm and configured to bias the arm in a first rotational direction.

7. The layboy conveyor of claim 6, wherein the first roller contacts an outer surface of the belt and the second roller contacts an inner surface of the belt.

8. The layboy conveyor of claim 4, further including means for maintaining a tension on the belt.

9. The layboy conveyor of 4, wherein shifting the first frame element relative to the second frame element shifts the first support roller relative to the first end of the upper conveyor.

10. The layboy conveyor of claim 4, including at least one support projecting from the first end of the lower conveyor away from the second end of the lower conveyor, the at least one support being mounted for linear movement with the first support roller when the first actuator moves the first support roller relative to the second support roller.

11. The layboy conveyor of claim 10, wherein the at least one support comprises at least one pivotable finger.

12. The layboy conveyor of claim 10, wherein the at least one support comprises a portion of a second actuator controllably shiftable between extended and retracted positions relative to the first support roller.

13. The layboy conveyor of claim 1, wherein the lower conveyor comprises at least one frame element, a first support roller, a second support roller, and a belt extending around the first support roller and second support roller, the layboy conveyor further including means for adjusting a distance from the lower conveyor first end to the lower conveyor second end.

14. A stacking apparatus comprising:

the layboy conveyor of claim 1;

a transfer conveyor having a first end at the second end of the layboy conveyor and having a second end;

a main conveyor having a first end at the second end of the transfer conveyor.

15. The stacking apparatus of claim 14, wherein the first end of the transfer conveyor is fixed relative to the second end of the layboy conveyor.

16. The layboy conveyor of claim 1, wherein the first end of the upper conveyor and the first end of the lower conveyor define a conveyor intake end and wherein the second end of the upper conveyor and the second end of the lower conveyor define a conveyor discharge end and wherein moving the first end of the lower conveyor changes a location of an intake nip of the layboy conveyor.

17. The layboy conveyor of claim 16, wherein the length of the lower conveyor top is always less than or equal to a length of the upper conveyor bottom.

18. A layboy conveyor having an intake end and a discharge end and comprising:

an upper conveyor having a top and a bottom and an intake end and a discharge end;

a lower conveyor having a top and a bottom and an intake end and a discharge end, the lower conveyor top being disposed adjacent to the upper conveyor bottom and defining with the upper conveyor bottom a transport path configured to transport a sheet of material in a direction from a nip having an upstream end at the intake end of the layboy conveyor to the discharge end of the layboy conveyor;

a drive operably connected to the upper conveyor and to the lower conveyor, the drive configured to drive the upper conveyor bottom and the lower conveyor top in the direction, and adjusting means for changing a distance between the upstream end of the nip and the second end of the upper conveyor.

19. The layboy conveyor of claim 18, wherein the lower conveyor comprises a belt at least partially defining the lower conveyor top and the lower conveyor bottom, and the layboy conveyor further including belt tensioning means for maintaining a substantially constant tension of the belt when the nip adjusting means changes the distance between the nip and the discharge end of the upper conveyor.

20. A method comprising:

providing a layboy conveyor, the layboy conveyor having an upper conveyor having a top and a bottom and a first end and a second end, and a lower conveyor having a top and a bottom and a first end and a second end, the lower conveyor top being disposed adjacent to the upper conveyor bottom and defining with the upper conveyor bottom a transport path configured to transport a sheet of material in a direction from the first end of the layboy conveyor to the second end of the layboy conveyor, and a drive operably connected to the upper conveyor and to the lower conveyor and configured to drive the upper conveyor bottom and the lower conveyor top in the direction, positioning the layboy conveyor with the first end of the upper conveyor and the first end of the lower conveyor adjacent to an output of a sheet feeding apparatus such that the first end of the upper conveyor is spaced a first distance from the sheet feeding apparatus and the first end of the lower conveyor is spaced a second distance from the sheet feeding apparatus, and changing the second distance by changing the length of the lower conveyor without changing the first distance.

* * * * *